US005918962A

United States Patent [19]

Nagano

[11] Patent Number: 5,918,962

[45] Date of Patent: Jul. 6, 1999

[54] DUAL STEP LIGHT AND AISLE INDICATOR APPARATUS

[75] Inventor: Thomas T. Nagano, Cerritos, Calif.

[73] Assignee: Tivoli Industries, Inc., Santa Ana, Calif.

[21] Appl. No.: 08/433,237

[22] Filed: May 2, 1995

Related U.S. Application Data

[63] Continuation-in-part of application No. 08/078,627, Jun. 16, 1993, Pat. No. 5,430,627.

[51] Int. Cl.[6] ..... F21S 1/02

[52] U.S. Cl. ..... 362/146; 362/240; 362/481

[58] Field of Search ..... 362/81, 146, 125, 362/224, 225, 240, 481, 495

[56] References Cited

U.S. PATENT DOCUMENTS

| | | | |
|---|---|---|---|
| D. 311,588 | 10/1990 | Nagano | D26/24 |
| D. 312,135 | 11/1990 | Nagano | D26/2 |
| 3,885,144 | 5/1975 | Lewis et al. | 362/146 X |
| 4,161,021 | 7/1979 | George, Jr. | 362/252 |
| 4,271,458 | 6/1981 | George, Jr. | 362/236 |
| 4,544,996 | 10/1985 | George | 362/238 |
| 4,612,606 | 9/1986 | Roberts | 362/146 |
| 4,625,266 | 11/1986 | Winter | 362/146 |
| 4,665,470 | 5/1987 | George, Jr. | 362/236 |
| 4,782,745 | 11/1988 | George, Jr. | 99/483 |
| 5,045,981 | 9/1991 | Nagano | 362/219 |
| 5,222,799 | 6/1993 | Sears et al. | 362/146 |
| 5,430,627 | 7/1995 | Nagano | 362/146 |

FOREIGN PATENT DOCUMENTS

| | | |
|---|---|---|
| 0152079 | 8/1985 | European Pat. Off. . |
| 8815598 | 5/1989 | Germany . |
| 4446693 | 6/1996 | Germany . |
| 2142672 | 1/1985 | United Kingdom . |
| 2185503 | 7/1987 | United Kingdom . |

OTHER PUBLICATIONS

Tivoli "Escort Lights" brochure, 1989, Tivoli Industries, Inc.

Tivoli "Guidelight Extrusions" brochure, 1992, Tivoli Lighting, Inc.

*Primary Examiner*—Stephen Husar
*Attorney, Agent, or Firm*—Price, Gess & Ubell

[57] ABSTRACT

A light fixture housing extrusion that includes a horizontal step plate intersecting a vertical riser plate and having first and second channels for mounting string light fixtures beneath removable translucent covers, the channels including grooved wall structures to facilitate securing of the covers and either a pair of tangs or a pair of interior recessed walls for receiving and retaining a spring-biased wedge clip lamp carriage. Other features include an improved wiring scheme with individually-fused light strings, a diode for dimming the light output of selected strings, and a riser lens cover having a unitarily-extruded extended shield which prevents viewing the direct glare from elevated lighting fixtures. An alternative glare reduction is provided by an opaque lens cover located directly above one or more lamps, the lens cover being mounted in a translucent extrusion structure, which mutes the lamp light, thus providing muted illumination on either side of the opaque lens cover. Edge and corner molding members for conformably mating with dual channel extrusion units and guiding electrical leads down the side of a staircase in concealed wire way channels are further provided.

57 Claims, 8 Drawing Sheets

DUAL STEP LIGHT AND AISLE INDICATOR APPARATUS

This application is a continuation-in-part of U.S. application Ser. No. 08/078,627, filed Jun. 16, 1993, now U.S. Pat. No. 5,430,627.

BACKGROUND OF THE INVENTION

1. Field of the Invention

The present invention relates to lighting fixtures and, more specifically, to extruded lighting fixtures for illuminating steps.

2. Description of Related Art

Low-voltage string-lighting systems have been used extensively for decorating and illuminating applications in both private homes and commercial establishments. Low-voltage string-lighting systems are often used to illuminate and decorate walls, floors, ceilings, and staircases of restaurants, nightclubs, hotels, and movie theaters.

A typical low-voltage string-lighting system, such as those used for aisle lighting, includes a power line having multiple miniature light fixtures attached thereto (hereinafter a "light string"), an external housing made of a durable material such as vinyl or aluminum, and an external covering which is translucent and generally fits within the housing. The external housing is typically manufactured by an extrusion process and is commonly referred to in the lighting industry as an extrusion.

A single light string in a common string-lighting system may include dozens of individual light bulbs. Because string-lighting systems include so many light bulbs, it is common for some of the bulbs to burn out. Thus, it is frequently necessary to replace one or more light bulbs on a light string. It may also be desirable to change light bulbs for decorative reasons, for example, to change the bulbs to a different color. It is therefore desirable to have a decorative string-lighting system which has easily-replaceable light bulbs.

Additionally, shorts in individual light bulbs may arise, for example, in the course of changing bulbs or from various other causes. Conventionally, such a short blows a fuse in a main transformer, causing all light bulbs illuminating, for example, an entire staircase, to go out.

While advances have been made in fixtures providing replaceable light bulbs, the fixtures themselves are typically nonremovably fixed in place or otherwise difficult to access. A need therefore exists in the art for improved lighting structures and circuitry featuring optimally-disposed lighting channels for providing both illumination of step paths and visibility from distances, as well as easily-removable fixtures and replaceable lights. There is also a need for controlling the intensity of lighting, for example, to dim the lighting or to prevent viewing the direct glare visible when riser lighting is provided above eye level.

SUMMARY OF THE INVENTION

The present invention provides improved step lighting apparatus configured to facilitate installation on the edge or "nosing" of a step. The invention particularly contemplates a stair mountable fixture adaptable to provide lighting in conjunction with a staircase and a molding apparatus mounted at the edge or side of the fixture for concealing one or more electrical leads emanating from the fixture and for providing a finished appearance at the edge or side. Another aspect of the invention is the provision of coextruded light transmissive and opaque regions in a stair lamp fixture.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in conjunction with the accompanying drawings, of which:

DETAILED DESCRIPTION OF THE PREFERRED EMBODIMENTS

Figure 1:
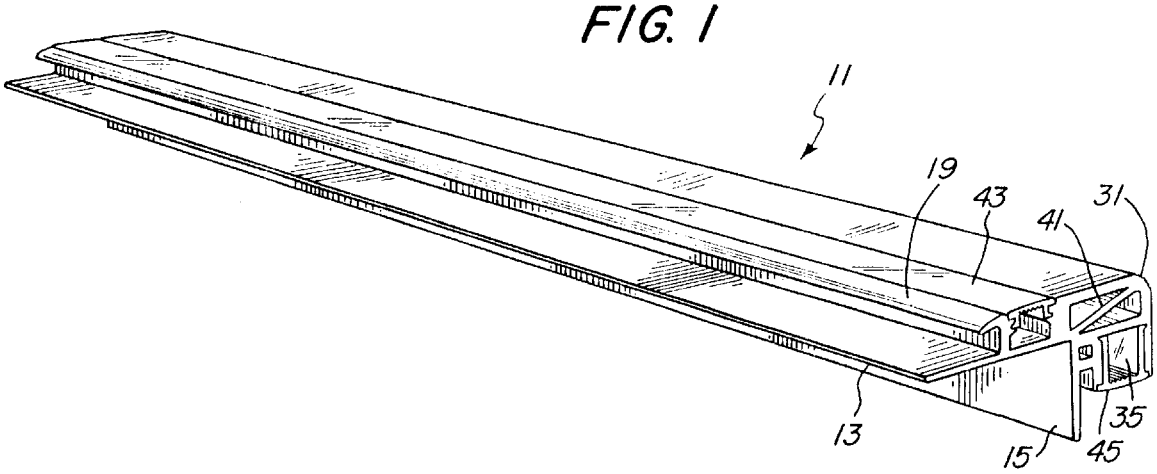
FIG. 1 is a top rear perspective of a step lighting apparatus according to a preferred embodiment.
Figure 2:
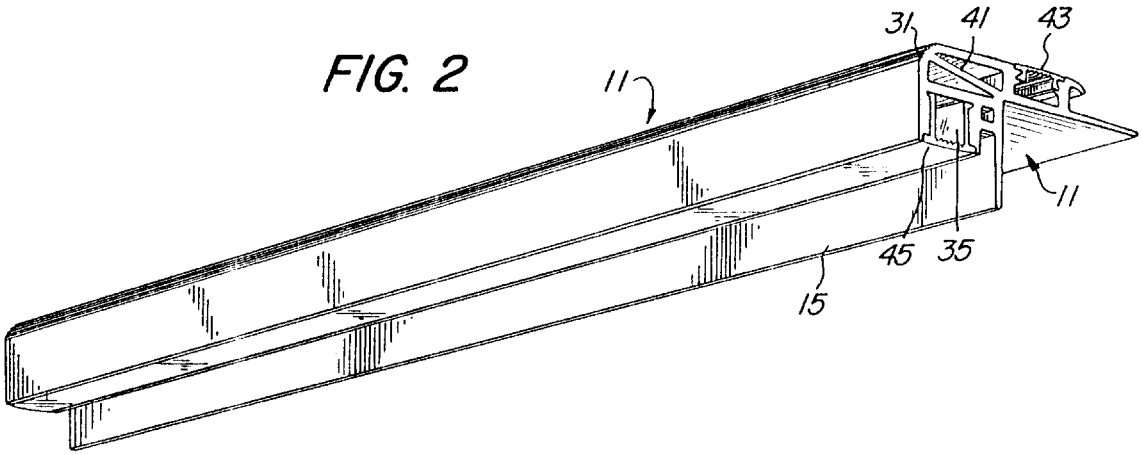
FIG. 2 is a bottom front perspective of the lighting apparatus of FIG. 1.
Figure 3:
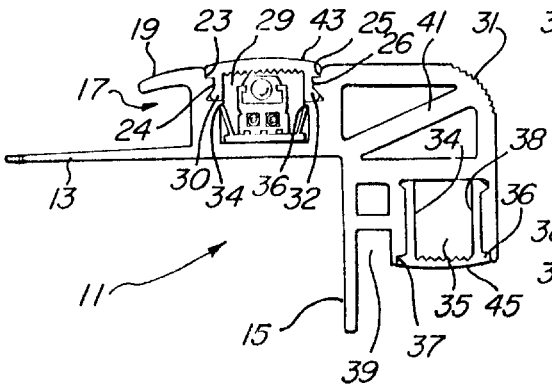
FIG. 3 is a cross-sectional view of one end of the lighting apparatus of FIG. 1.
Figure 4:
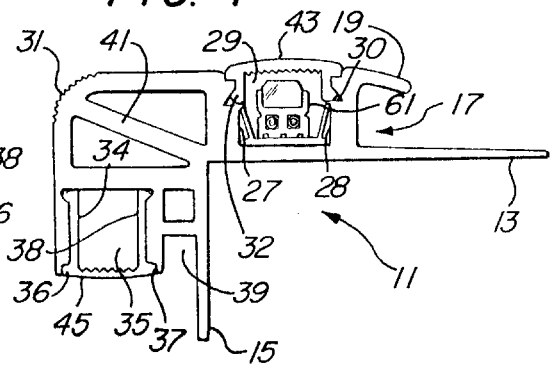
FIG. 4 is a cross-sectional view of the lighting apparatus of FIG. 1 showing the end opposite that shown in FIG. 3.
Figure 5:
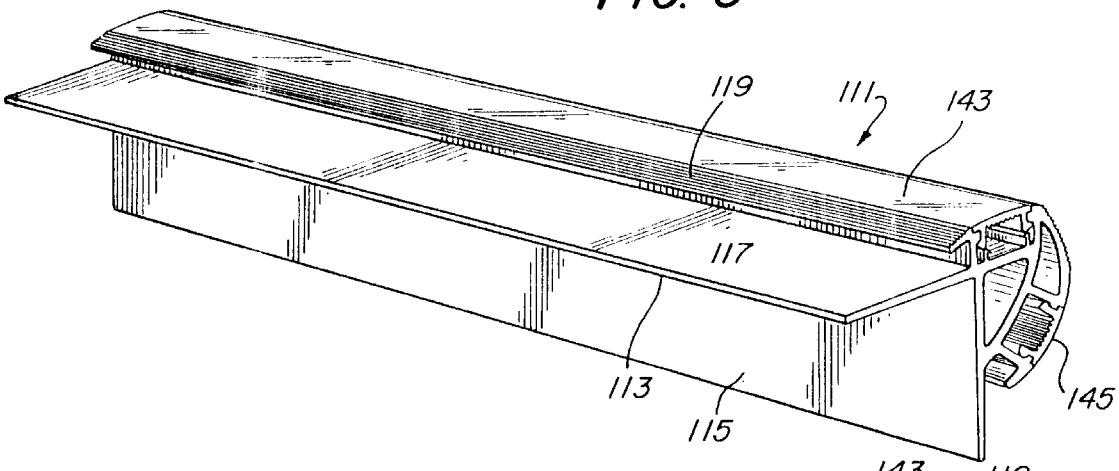
FIG. 5 is a top rear perspective of a second embodiment of the lighting apparatus according to a preferred embodiment.
Figure 6:
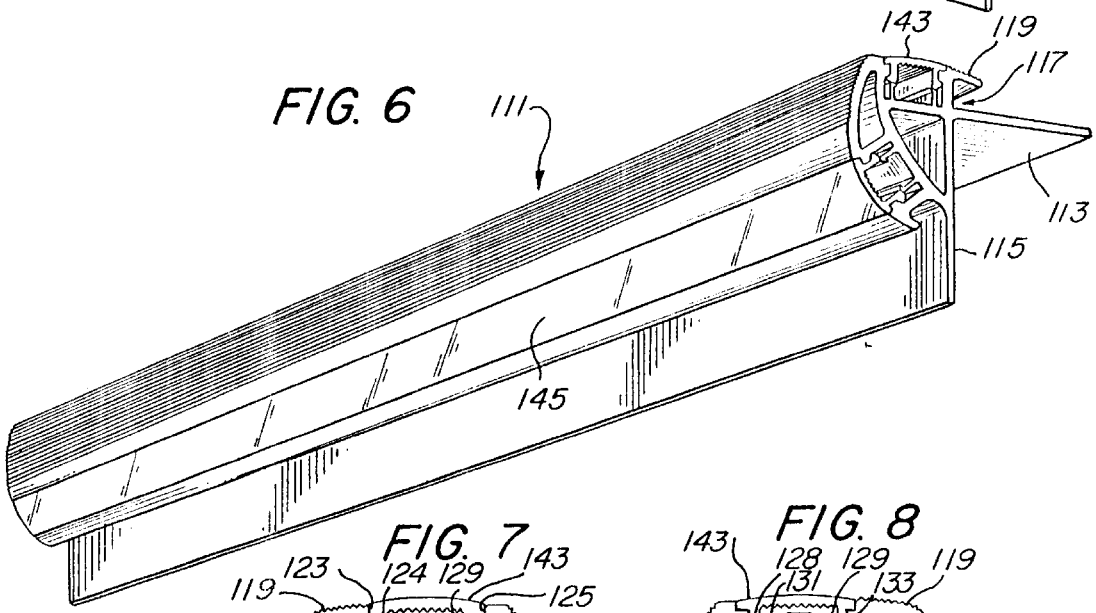
FIG. 6 is a bottom front perspective of the lighting apparatus of FIG. 5.
Figure 7:
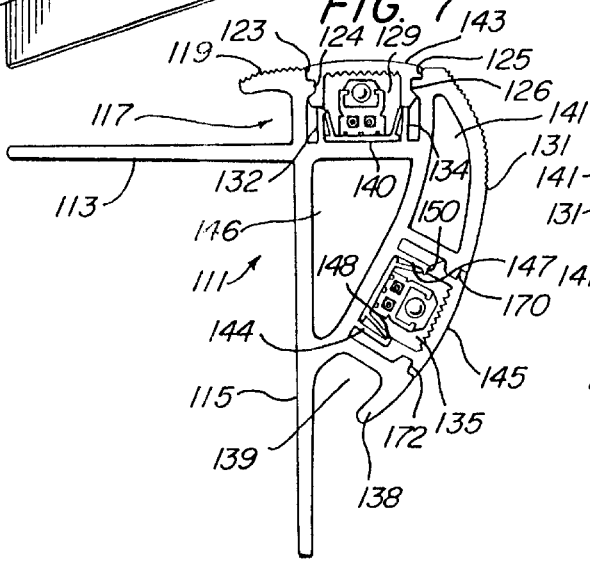
FIG. 7 is a cross-sectional view of one end of the lighting apparatus of FIG. 5.
Figure 8:
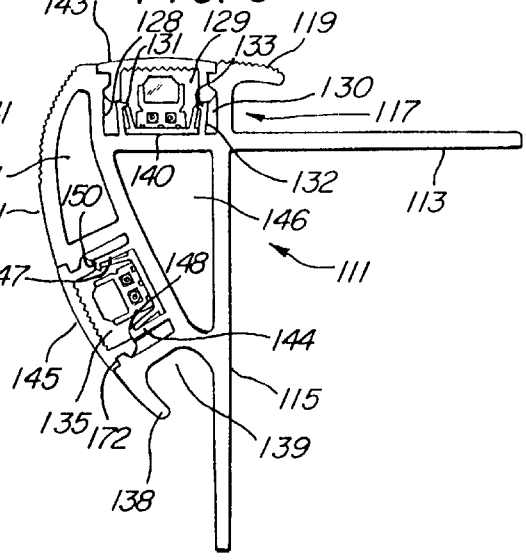
FIG. 8 is a cross-sectional view of the lighting apparatus of FIG. 5 showing the end opposite that shown in FIG. 7.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide various readily-manufacturable, easily installable, and aestheticallypleasing dual channel step light fixtures.

FIGS. 1–4 illustrate a light fixture housing extrusion 11 according to a preferred embodiment of the invention. The extrusion 11 includes a horizontal step plate 13 and vertical riser plate 15, which intersect in a right angle. The extrusion 11 is preferably vinyl for durability, but may be extruded from other materials, such as polycarbonate. A lip 19 extends over the horizontal step plate 13 and is integrally-formed therewith. The lip 19 provides a gently curved extension defining a carpet insert slot 17.

Adjacent the lip 19 is a first channel 29. This first channel 29 includes respective channel walls 27, 28 in which are formed a first pair of generally oppositely-disposed grooves 23, 25 and a second pair of generally oppositely-disposed grooves 30, 32. These grooves 23, 25; 30, 32 define a first pair of oppositely-disposed tangs 24, 26 and a second pair of oppositely-disposed tangs 34, 36 extending from the respective walls 27, 28 of the channel 29. A first translucent plastic cover 43 is fitted into the channel 29 and is shaped in cross-section to snap-fittingly mate with the pairs of grooves 23, 25; 30, 32. This lens cover 43 may be referred to as a "tread lens cover." A light string including lamp carriages 61 is inserted in the channel 29 to illuminate the top edge of a step.

Beyond the first channel 29, the external surface of the housing extrusion 11 continues horizontally and is then curved vertically downward through 90 degrees, to form a rounded corner surface 31. A portion of the surface 31 is ribbed or serrated to create an antiskid surface. The area over which the serrations appears may, of course, be varied. A rectangular interior opening lies within the contour of corner surface 31 and includes a diagonal rib 41 for structural support.

A second, generally rectangular channel 35 is defined beneath the corner 31. The second channel 35 has first and second interior walls 34, 38 in which are formed oppositely-disposed grooves 36, 37. A second carpet insert slot 39 of generally rectangular cross-section is formed adjacent the generally rectangular channel 35. A second translucent plastic cover 45 is snap-fittingly mated with the grooves 36, 37. This lens cover 45 may be referred to as a "riser lens cover." A light string (not shown) is also optionally installed in channel 35 to illuminate the base of a step. A line perpendicular to the base of the second channel 35 parallels the vertical wall 15 such that light emanating from the channel through cover 45 is directed downwardly and thus is relatively muted to the viewer.

Light strings, including light fixtures 61, may be installed in either channel 29, 35, or both, as desired. In an embodiment where no light string is installed in the first channel 29, an opaque tread lens cover may be used to give the appearance of a continuous tread surface.

Figure 9:
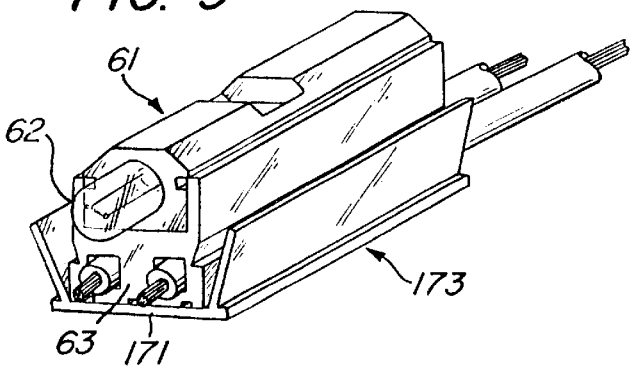
FIG. 9 is a perspective view of a spring clip fixture carriage.

One lighting fixture useable in apparatus configured according to the preferred embodiments 61 is that disclosed in U.S. Pat. No. 5,045,981, incorporated by reference herein and shown in more detail in FIG. 9. Briefly, this light fixture employs a light bulb 62 inserted in a socket which is releasably secured to a carriage 63. The electrical contact to a pair of leads on the light bulb 62 is made by a pair of arcuate terminals fastened within the carriage 63. The terminals have one free end so that they may bend freely upon insertion of the socket within the carriage. The socket includes a depression configured to conform to the shape of the arcuate terminals, so that the terminals snap into the depression when the socket is inserted into the carriage 63. The leads extend across the depression to improve the electrical contact. The socket is further secured to the carriage 63 by a pair of grooves which mate to the carriage's guiding rails.

According to the preferred embodiment, the lamp carriage 63 is attached to the base 171 of a metal wedge clip carriage 173, e.g., by gluing. The wedge clip carriage 172 includes two wings 172, 174 attached to the respective edges of the base and extending outwardly therefrom. The wings 172, 174 are springably attached to the base such that they may bend in an arc 176 about the position shown in FIG. 10*a*.

Figure 10A:
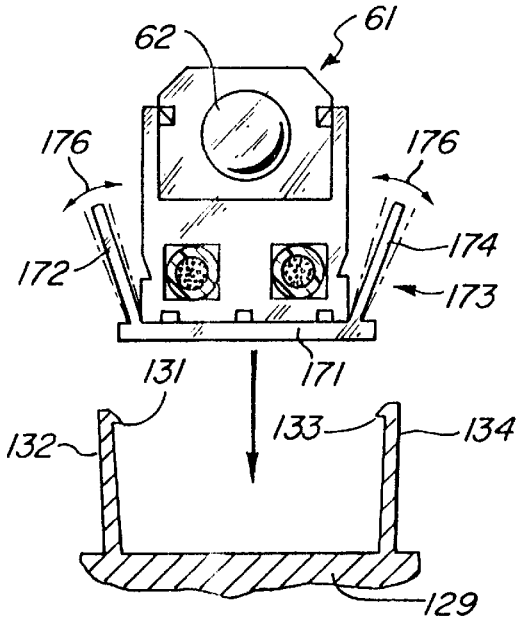
FIG. 10*a* is an exploded cross-sectional view of a spring clip carriage prior to insertion into the channel of lighting apparatus according to a preferred embodiment.
Figure 10B:
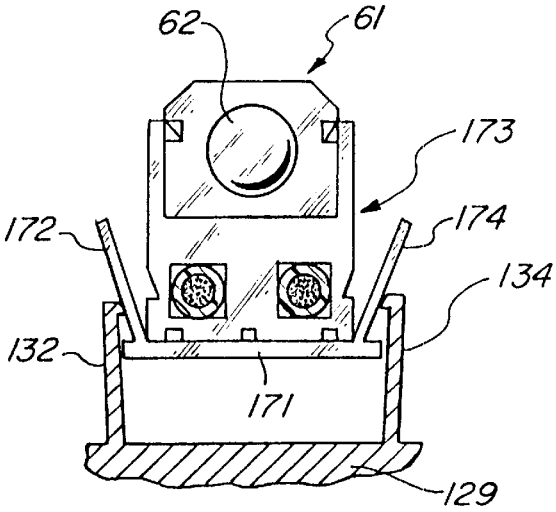
FIG. 10*b* is an exploded cross-sectional view of the spring clip lamp carriage of FIG. 10 at the initial stage of insertion into the channel.
Figure 10C:
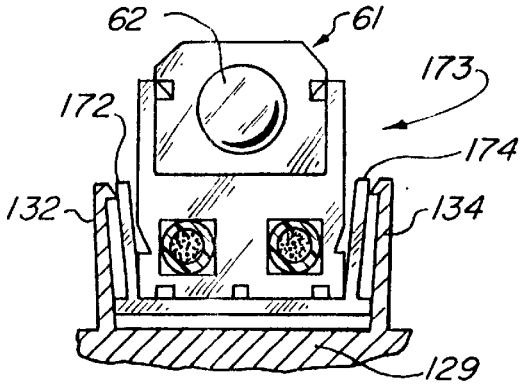
FIG. 10*c* is an exploded cross-sectional view of the spring clip lamp carriage at a second stage of insertion.
Figure 10D:
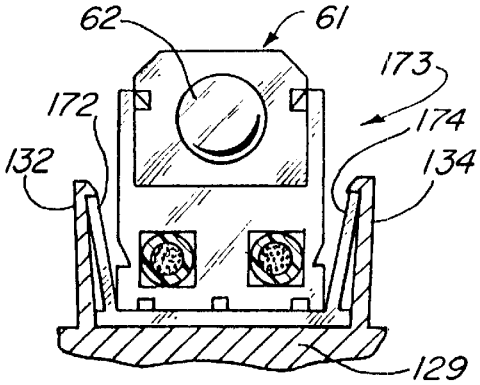
FIG. 10*d* is a cross-sectional view of the spring clip lamp carriage fully inserted into the channel.

FIGS. 10*a*–10*d* illustrate how the wedge clip carriage 173 is inserted into and retained by a cooperating channel such as 129. In FIG. 10*a,* the wedge clip carriage 173 is about to be inserted into the channel 129. In FIG. 10*b*, the wedge clip carriage 173 is initially being inserted into the channel 129, and the wings 172, 174 are being slightly forced inward against their bias towards the light fixture 61. In FIG. 10*c*, the wedge clip carriage 173 is almost completely inserted into the channel 129, and the wings 172, 174 have been forced inward by tangs 131, 133 located on a pair of relatively rigid interior channel walls 132, 134. FIG. 10*d* illustrates the wedge clip lamp carriage 173 completely inserted, in which position the wings 172, 174 have released outwardly against the walls 132, 134 and beneath the tangs 131, 133.

With respect to channel 129, it will be observed, for example, from FIG. 10*e,* that the tangs 131, 133 are raised above the base of the channel 129 to a height sufficient such that the base 171 of the wedge clip carriages 173 will not bottom out as the spring clip sides or wings 172, 174 are pinched in by the tangs 131, 133, thereby permitting the carriages 173 to be snapped into the channel 129.

FIGS. 5–8 illustrate a light fixture housing extrusion 111 according to a second preferred embodiment of the invention. The extrusion 111 again includes a horizontal step plate 113 and vertical riser plate 115, which intersect in a right angle. The top surface of the horizontal step plate 113 again underlies an integrally-formed lip 119. The lip 119 comprises a gently curved extension forming a carpet insert slot 117.

Adjacent the lip 119 is a first channel 129. Channel 129 includes channel walls 128, 130 in which is formed a pair of generally oppositely-disposed grooves 123, 125. The grooves 123, 125 define a first pair of oppositely-disposed tangs 124, 126 extending from the respective walls 128, 130 of the channel 129.

The floor 140 of the first channel 129 includes first and second recessed interior walls 132, 134 defining an interior channel within channel 129. Each interior wall 132, 134 terminates at its upper end in inwardly-directed tangs 131, 133. The use of separate interior walls 132, 134 permits the translucent cover 143 over the light channel 129 to be of any desired width, while still accommodating a fixture 61 of a standard width.

Beyond the first channel 129, the external surface of the housing extrusion 111 slopes outwardly, sharply downward, and then inward, forming a corner 131 of "ear-shaped" cross-section. A portion of the surface of the corner 131 is again ribbed or serrated to create an antiskid surface. The ear-shaped corner 131 includes first and second interior openings 141, 146 within its contour.

A second channel 135 is defined in the downwardly- and inwardly-sloping portion of corner 131. A line perpendicular to the planar floor of the second channel 135 forms a 60-degree angle with the vertical such that lighting in the channel provides a bold illumination of the step to a user which is visible from considerable distances. The interior structure of the second channel 135 is similar to that of the first channel 129 including a pair of grooves 170, 172 and interior walls 144, 147 carrying oppositely-disposed tangs 148, 150. A second carpet insert slot 139 of generally rectangular cross-section is formed by lip 138 extending below the second channel 135.

Figure 11:
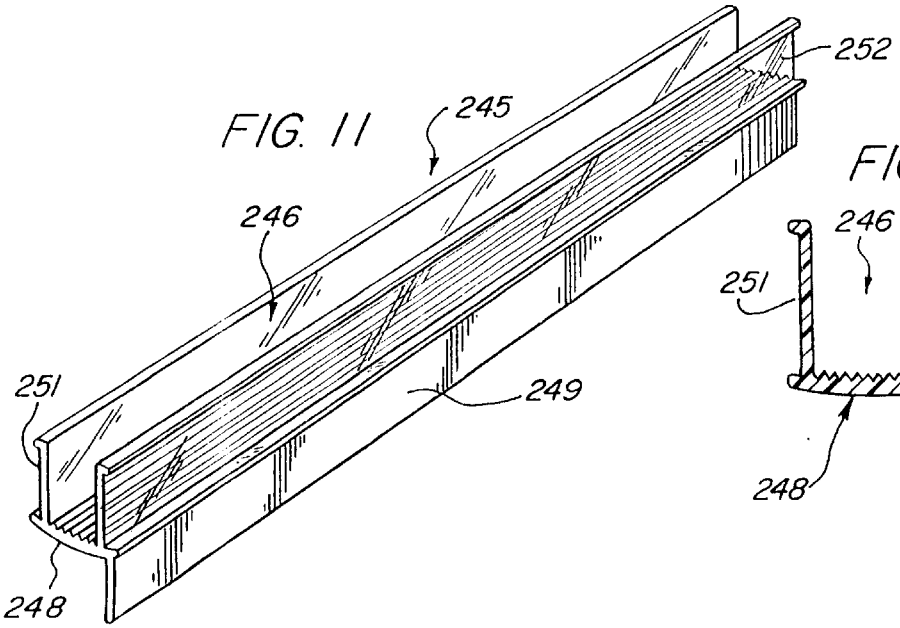
FIG. 11 is a side elevation of an improved riser lens cover.
Figure 12:
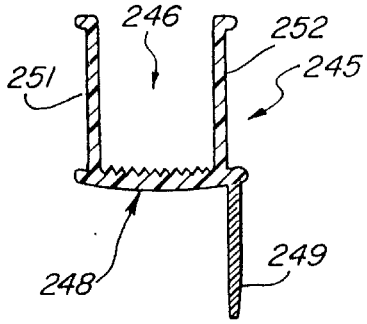
FIG. 12 is an end view of the riser lens cover of FIG. 11.
Figure 14:
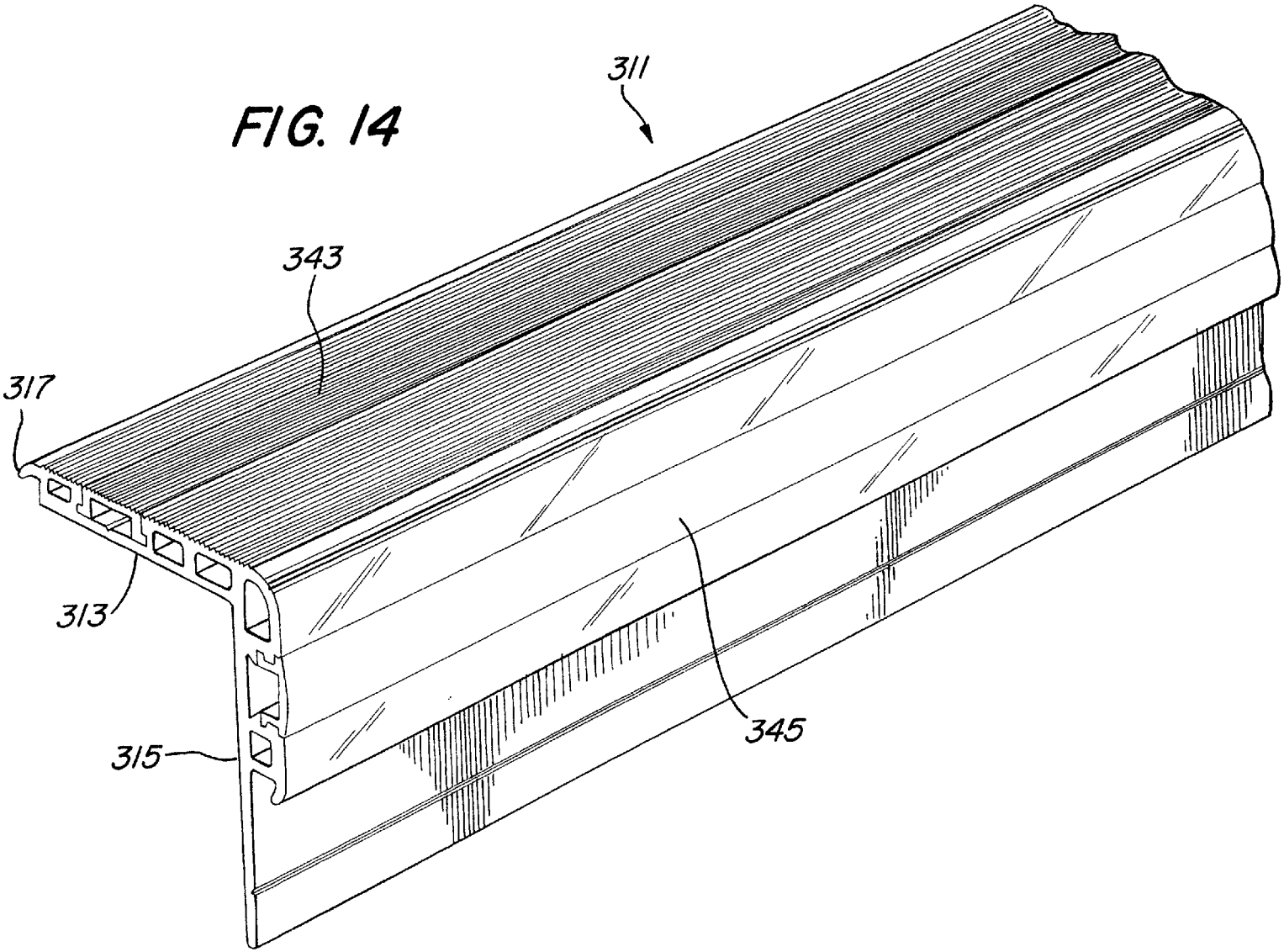
FIG. 14 is a perspective view of an alternate light fixture extrusion embodiment.

FIGS. 11 and 12 illustrate an improved riser plate lens cover 245. This lens cover 245 may be advantageously used to cover the second channel 35 in the embodiment of FIGS. 1–4.

The lens cover 245 includes an interior channel 246 of generally rectangular cross-section defined by first and second side walls 251, 252 and slightly arcuate top surface 248. Extending downward vertically from the top surface 248 is a generally rectangular, planar shield 249. The entire lens cover 245 is preferably a single vinyl extrusion with the side walls 251, 252 and top surface 248 being of a translucent material and the shield 249 being of an opaque black material. The shield 249 functions in a staircase which rises above eye level to prevent glare of individual light fixtures from reaching the eye of someone approaching or using the staircase.

Figure 13:
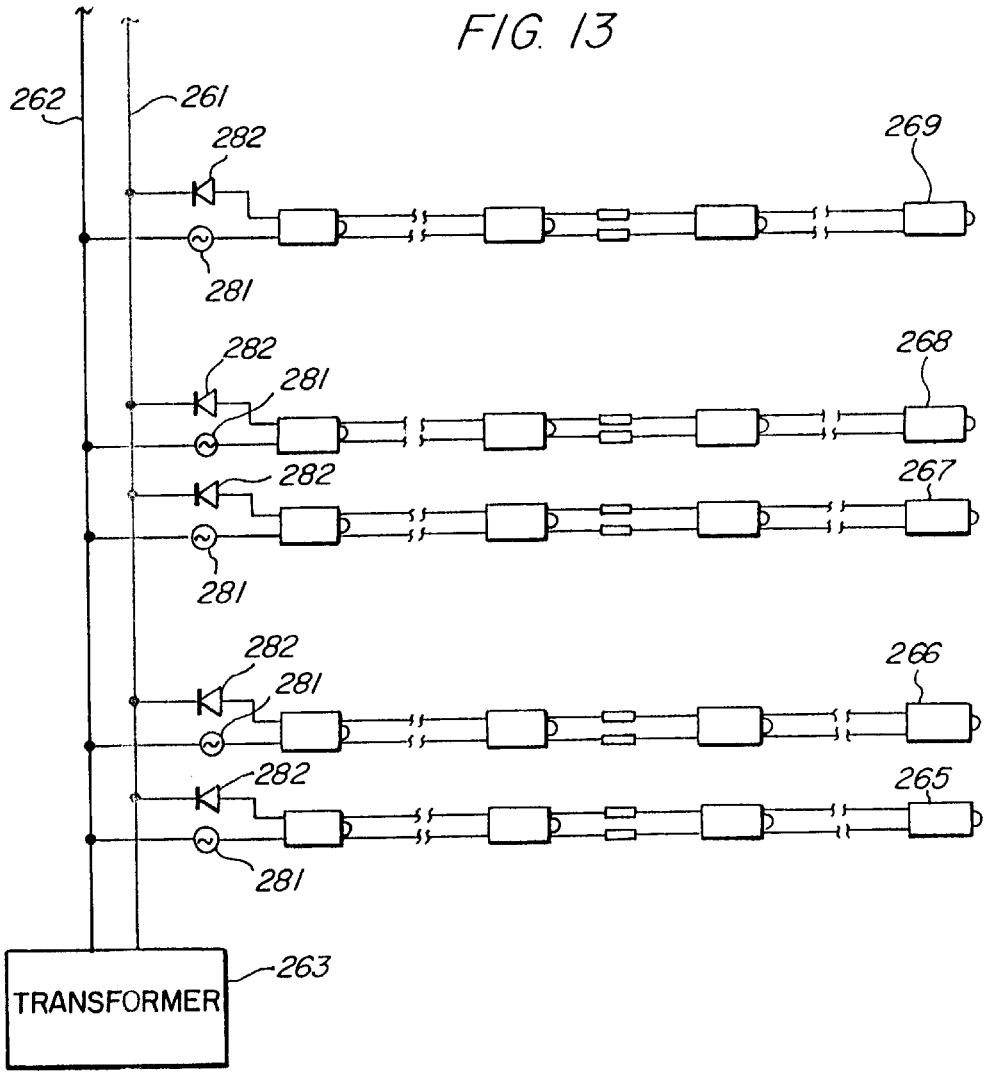
FIG. 13 is an electrical circuit diagram according to a preferred embodiment.

FIG. 13 discloses an improved electrical circuit particularly suitable for use with a staircase lighting system. As shown, main leads 261, 262 emanate from a transformer 263. Individual light strings 265, 266, 267, 268, 269 tap off the main leads 261, 262. Each individual string, e.g. 265, is installed in a respective channel, e.g. 29, of a light fixture housing extrusion, e.g. 11 (FIGS. 1–4). Assuming a light string is installed in each channel 29, 35 of a fixture according to FIGS. 1–4, there is a pair of strings for each step. Thus, strings 265, 266 illuminate one step, strings 267, 268 the next step, and so forth.

Each light string 265, 266 of FIG. 13 includes a fuse 281. The fuse 281 serves to prevent a short in one circuit, e.g. 265, from activating a circuit protector or fuse associated with transformer 263, which would disable the lighting of an entire stairway.

Alternating circuits 266, 268 also include a diode 282. The diode 282 causes a reduced amount of power (roughly one-half) to be supplied to the respective circuits 266, 268, thereby considerably dimming their illumination. Such dimming is particularly advantageous for the tread plate channels of extrusions used in movie theaters, where brighter lighting is distracting to the patrons.

FIGS. 14–17 illustrate a light fixture housing extrusion 311 according to a third preferred embodiment of the invention. The extrusion 311 includes a horizontal step plate 313 and vertical riser plate 315, which, in the illustrated embodiment, intersect in a right angle. The step plate 313 and riser plate 315 may intersect in other angles, for example, an acute angle, to accommodate a similarly-angled riser step portion. An integrally-extruded lip 319 extends over the horizontal floor surface 314 to provide a curved extension defining a carpet insert slot 317.

Adjacent the lip 319 is a first channel 329. This first channel 329 includes respective vertical channel side walls 327, 328, each of which has a lip 316, 318 extending therefrom. A first extruded hollow 320 is formed on one side of the first channel 329, while second and third extruded hollows 360, 363 separated by a rib 361 are formed on the opposite side of the first channel 329. A noncountersunk screw 366 is shown fastening the extrusion 311 in place.

A first plastic cover 343 is fitted into the channel 329 and is shaped in cross-section to have respective end tabs 364, 365 and so as to slidingly insert endwise into the channel 329. The cover 343 has a grooved opaque top surface 344 so as to present a continuous appearance when in place. In other applications, where lamps are provided in channel 329, the lens cover may be translucent or frosted. The lens cover 343 may be referred to as a "tread lens cover."

Beyond the first channel 329, the outer surface of the housing extrusion 311 continues horizontally and is then curved vertically downward through 90 degrees, to form a rounded corner surface 331. Although not shown in FIG. 16, a portion of the surface 331 may be ribbed or serrated to create an antiskid surface, if desired.

Figure 15:
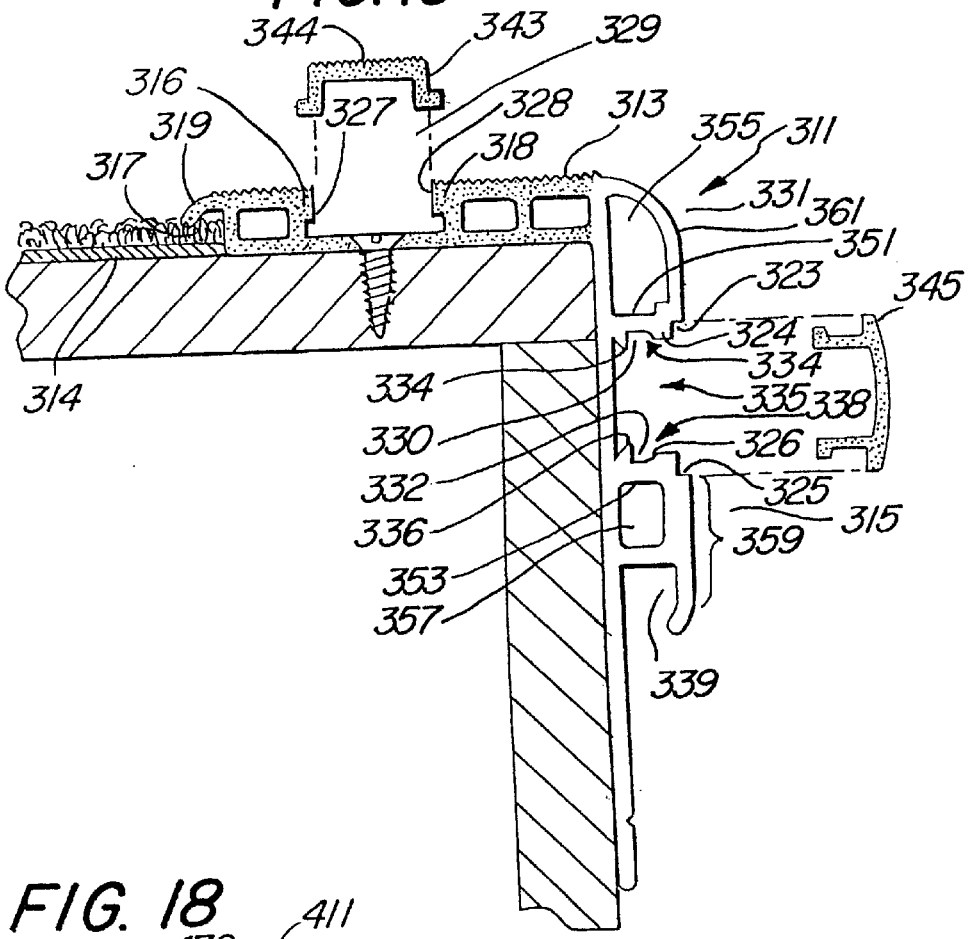
FIG. 15 is an end view of the extrusion of FIG. 14.
Figure 18:
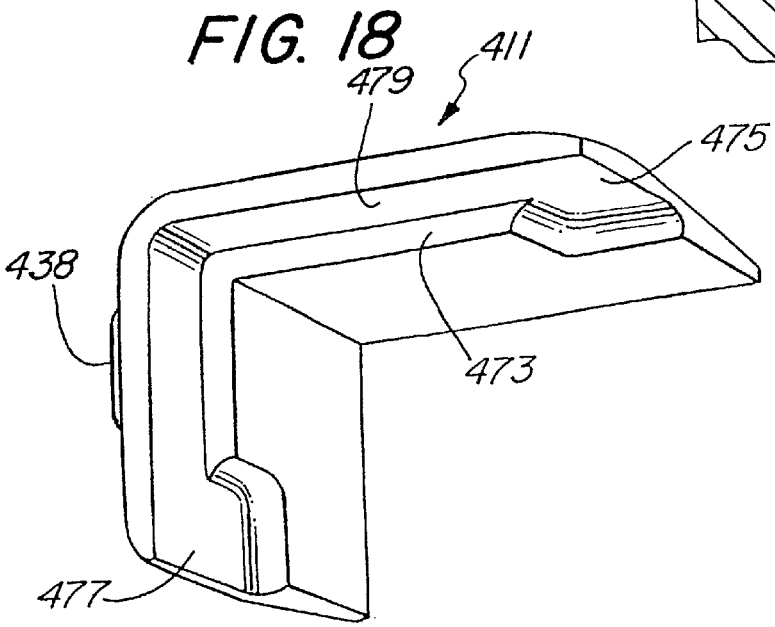
FIG. 18 is a perspective view of the corner molding member shown in FIG. 16.

While the surface of the horizontal step plate 313 of the extrusion 311 in the illustrated embodiment is preferably opaque and of a dark color, such as dark brown, the vertical riser plate 315 is a frosted translucent "white" or light color. This coloration is preferably achieved by fabricating the extrusion 311 as a two-color extrusion formed in a single coextrusion process wherein dark pigment, reflected by stippling in FIG. 15, is employed to create the opaque horizontal step plate portion 313. According to such a process, the coextrusion provides a urethane step plate 313 and a rigid polyvinylchloride or PVC riser plate 315. Such a urethane step plate 313 can be variously colored and provides a better nonskid surface than various other materials. Such coextrusions can be provided, for example, by ANB Plastics, Yakima, Wash.

A second, generally rectangular channel 335 is defined beneath the corner 331. The second channel 335 has first and second interior walls 334, 338. The channel 335 includes a first pair of generally oppositely-disposed grooves 323, 325 and a second pair of generally oppositely-disposed grooves 330, 332. These grooves 323, 325; 330, 332 define a first pair of oppositely-disposed tangs 324, 326 and a second pair of oppositely-disposed tangs 334, 336 extending from the walls 334, 338 of the channel 335. An opaque plastic cover 345 is snap-fittingly mated with the grooves 334, 336. This opaque lens cover 345 may be referred to as a "riser lens cover." A second carpet insert slot 339 is formed adjacent the channel 335.

The outer surfaces 351, 353 of the respective side walls 334, 338 form the interior side surface of respective hollows 355, 357, each of uniform cross-section and extending through the extrusion 11 on either side of the second channel 335. Since the side walls 334, 338 are light transmissive and preferably translucent, light from a lamp string positioned in the channel 335 will be transmitted into each hollow 355, 357 and to the respective vertical surfaces 359, 361 of the riser plate 315. At the same time, passage through the translucent walls mutes the light so as to provide the relative low level or gentle illumination desired on the vertical side portion of the extrusion 11.

A light string 476 (FIG. 17) is placed or attached in the channel 335 to illuminate the riser portion of a step. Light strings, including light fixtures 361, may be installed in appropriately constructed channels 329, 335, or both, in various embodiments. Again, the lighting fixture 361 may be that disclosed in U.S. Pat. No. 5,045,981, incorporated by reference herein and shown in more detail in FIG. 9.

Figure 16:
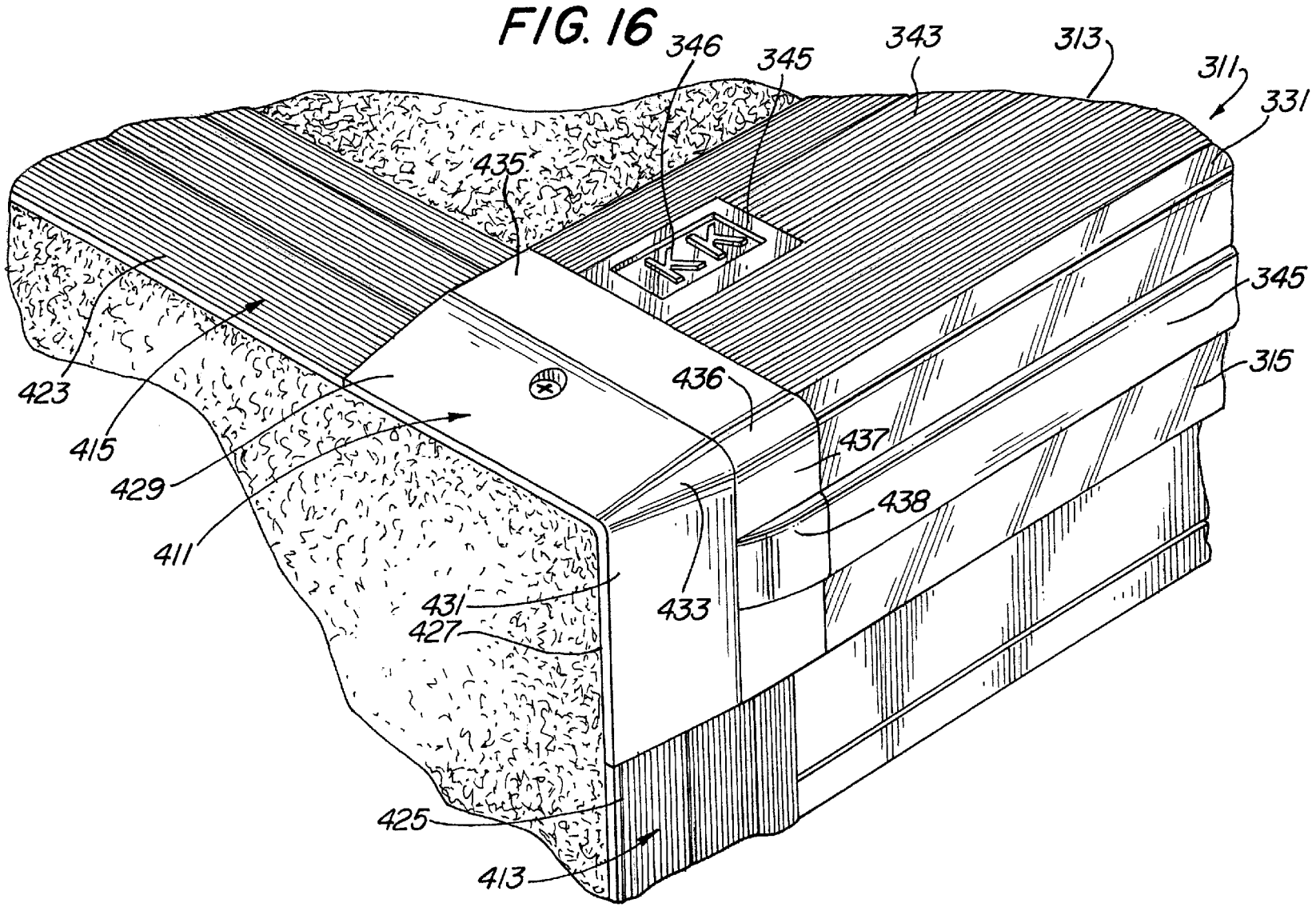
FIGS. 16 and 17 are perspective views illustrating edge molding apparatus according to a preferred embodiment.

As shown in FIG. 16, at the end of the channel 329, a translucent molded plastic indicator insert 345 is provided, which is also shaped in cross-section to slidingly insert endwise into the channel 329. A label 346, such as a row designator label or decal, is shown applied to the top surface of the insert 345. A light string 360 including one or more lamps 361 is inserted in the channel 329 to illuminate the label 346.

FIG. 16 illustrates a carpet step end cap 411. The end cap 411 is a right-angle or corner molding member, preferably fabricated of injection molded plastic. The end cap 411 adjoins a vertical edge molding member 413 and a horizontal edge molding member 415. Each edge molding member 413, 415 may be a section of the same plastic extrusion. The edge molding members 413, 415 each have respective top surfaces 423, 425 which taper down to the edge 427 of the cooperating mounting surface, typically the tread and riser portions of a step. The horizontal and vertical tapered top surfaces 429, 431 of the corner molding member 411 are joined together via a rounded and tapered surface 433 which may comprise or approximate a section of a cone. The horizontal top surface 429 forms integrally into a flat horizontal edge surface 435, while the vertical top surface 431 forms into a generally flat vertical edge surface 437 having a centrally-located raised portion or projection 438 thereon.

The raised portion 438 is positioned and sized to conform to the shape of the opaque cover 345 and is tapered down as it progresses away from the adjoining edge of the cover toward its termination at the far end of the vertical edge surface 437. The raised portion 438 conformably mates with and thus appears as an extension of the opaque cover 345, contributing to the overall aesthetic appearance of the assembly. The vertical edge surface 437 meets the horizontal edge surface 435 in a generally rounded surface 436 lying behind the conical section 433.

Figure 17:
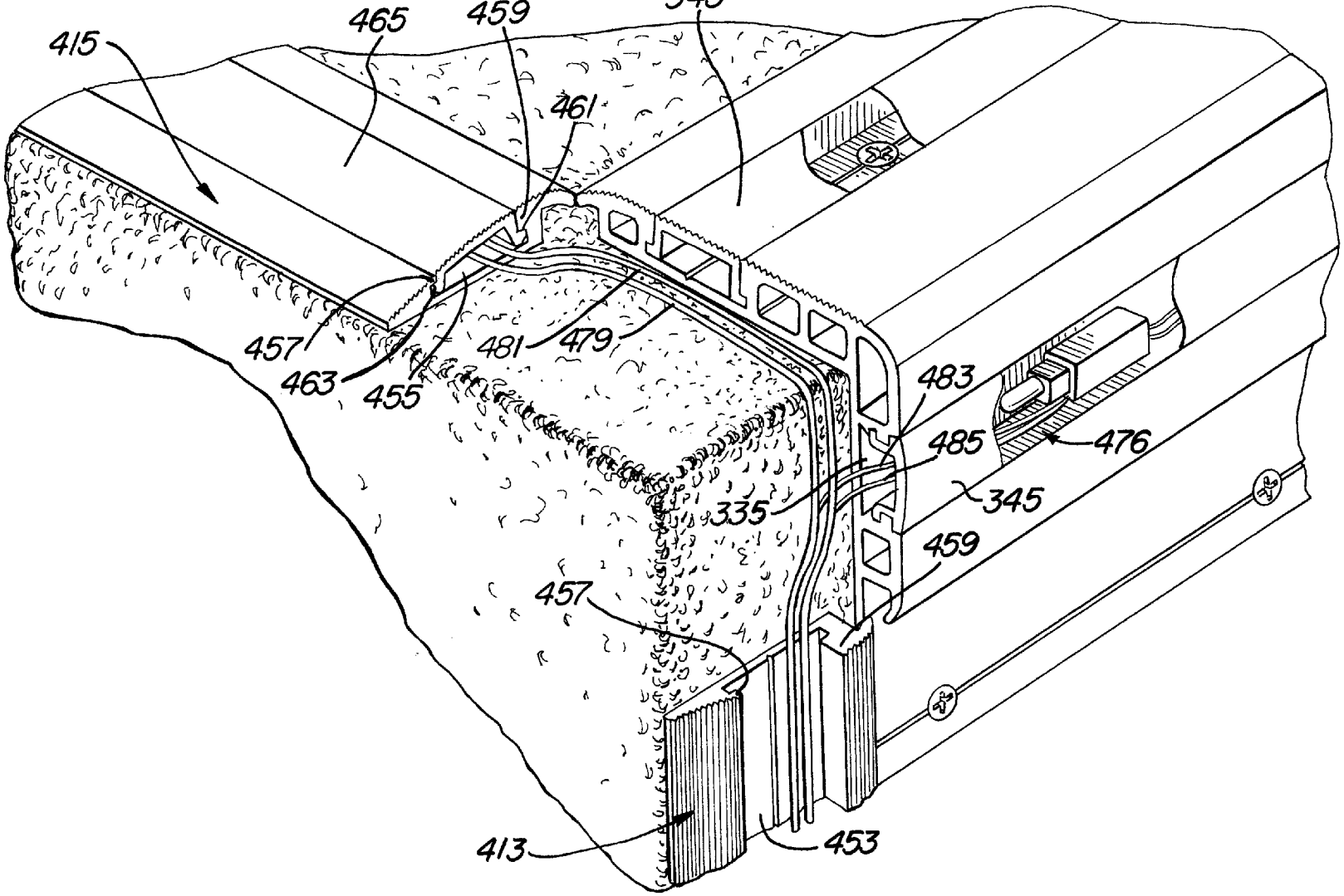

As shown in FIG. 17, each of the edge molding members 413, 415 has a central wire way channel 453, 455 formed therein, having respective side projections 457, 459 thereon, which mate with respective grooves 461, 463 on mating, slide-in covers, e.g. 465. The top surfaces of the cover 465 and the vertical and horizontal edge molding members 413, 415 may be serrated, as desired, and as shown in FIG. 16.

The corner molding member 411 preferably has an interior channel or undercut defined by a molded interior edge 473. The edge 473 defines an upper recessed pool area 475, a lower recessed pool area 477, and a narrower channel or conduit 479 joining the two recessed pool areas 475, 477. As may be appreciated from FIG. 17, the central channels 453, 455 and the interior channel 473 guide electrical leads 479, 481 down the side of a staircase structure, while cooperating leads 483, 485 are tapped off to respective branch lamp circuits lighting respective riser step portions down the staircase. The recessed areas 475, 477 accommodate the bending of the leads 479, 481 such that they turn towards and pass adjacent the edge 480 of the extrusion 311.

The corner molding member 411 further has four integral alignment tangs 490, 491, 493, 495 extending from a side edge 496 thereof. Three of the tangs 490, 491, and 495 are of similar length and insert, respectively, into hollows 357, 363, and 320 of the extrusion 311, where they serve to interlock the molding member 411 with the extrusion, with or without application of glue. The fourth tang 493 is longer and is formed and positioned to rest on the surface of the floor of the channel 329 such that a screw, e.g., 366, FIG. 15, may pass therethrough to anchor the molding member 411 in place.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. Lamp fixture apparatus for installation on a first step having a riser portion and tread portion and comprising:

a single-piece extrusion having a riser plate portion and a horizontal tread plate portion;

a first channel formed in said horizontal tread plate portion and providing a channel opening disposed to open outwardly away from said tread portion of said step;

a second channel formed in said riser plate portion and providing a channel opening disposed to facilitate direction of light from a plurality of light sources located therein toward a second step;

a vertical edge molding member having a planar top surface tapering down to an edge;

a horizontal edge molding member having a planar top surface tapering down to an edge; and a corner molding member located adjacent said extrusion and having a planar horizontal top surface portion shaped to mate flush with a planar top surface of said horizontal edge molding member and a vertical top surface portion shaped to mate flush with the planar top surface portion of said vertical edge molding member.

2. The lamp fixture apparatus of claim 1 further including first and second lens covers shaped to fit into and cover the respective channel openings of said first and second channels.

3. The lamp fixture apparatus of claim 2 wherein said first and second channels are each of a width and depth selected to permit installation of at least one lamp unit therein.

4. The lamp fixture apparatus of claim 3 further including a light string located in at least one of said first and second channels.

5. The lamp fixture apparatus of claim 3 further including first and second carpet insert slots formed in said single-piece extrusion at opposite ends thereof.

6. The lighting apparatus for mounting on a first step comprising:

a step plate structure comprising a first carpet insert slot of uniform cross-section, said step plate structure further including a first extruded channel of uniform cross-section positioned adjacent said carpet insert slot, said first channel having a floor and first and second vertical side walls, said first extruded channel further having an open top surface, said step plate structure further including a nose portion formed adjacent said first channel and positioned to overhang the step;

a second extruded channel located on an underside of said nose portion and having first and second side walls defining a constant cross-section of said second extruded channel, the first and second side walls of said second extruded channel being disposed to facilitate directing light from a string of light sources disposed in said second channel downward toward a tread surface of a second step;

a channel cover shaped to fit into at least one of said first and second channels; and molding means mountable at a side of said step plate structure for concealing at least one electrical lead and providing a finished appearance at a side of said first step.

7. The lighting apparatus of claim 6 further including at least one light string disposed in one of said first and second channels.

8. The lighting apparatus of claim 6 wherein said molding means comprises corner molding member means for covering at least one of said channels and having at least one surface meeting flush with a cooperating surface of said step plate structure.

9. The lighting apparatus of claim 8 wherein said molding means further includes raceway means for conducting at least one electrical lead down the side of said first step and further including means for covering said raceway means so as to provide a smooth and finished appearance.

10. The lighting apparatus of claim 9 wherein said molding means further includes a horizontal edge molding member and an electrical lead raceway formed therein.

11. Lighting apparatus for providing lighting in conjunction with first and second steps, the first step being above the second, comprising:

a dual light channel stair lighting fixture having a first channel disposed to receive lights providing illumination viewable from above the first step and a second channel disposed to receive lights providing illumination directed downwardly toward the second step; and molding means mountable at the side of said stair lighting fixture for concealing electrical leads extending out of said fixture and providing a finished appearance at a side of said first step.

12. The lighting apparatus of claim 11 wherein said molding means includes corner piece means for covering at least one of said channels and having at least one surface meeting flush with a cooperating surface of said fixture.

13. The lighting apparatus of claim 12 wherein said molding means further includes raceway means for conducting at least one electrical lead down the side of said first step and further including means for covering said raceway means so as to provide a smooth and finished appearance.

14. The lighting apparatus of claim 13 wherein said molding member means further includes a tread molding member and an electrical lead raceway formed therein.

15. A lighting apparatus comprising:

a stairstep mountable fixture having first and second openings in respective outer surfaces thereof, each opening oriented to facilitate direction of illumination from within said fixture in respective first and second directions; and molding means mountable at a side of said fixture for concealing electrical leads extending out of said fixture and for providing a finished appearance at said side.

16. The lighting apparatus of claim 15 wherein said fixture further comprises a single piece extrusion having a vertical riser plate portion and a horizontal tread plate portion.

17. The lighting apparatus of claim 16 wherein said extrusion is of a length selected to match the length of a nose portion of said stairstep.

18. The lighting apparatus of claim 17 wherein each of said first and second openings runs the length of said extrusion.

19. The lighting apparatus of claim 15 wherein said molding means includes a corner molding member having at least one surface meeting flush with a cooperating surface of said fixture.

20. The lighting apparatus of claim 19 wherein said molding means further includes wireway means for conducting at least one electrical lead across a tread portion of said stairstep and further including means for covering said wireway means so as to provide a finished appearance.

21. The lighting apparatus of claim 19 wherein said molding means further includes a horizontal edge molding member and an electrical lead wireway formed therein.

22. The lighting apparatus of claim 20 wherein said fixture includes a riser plate portion and a tread plate portion and wherein said molding means comprises:

a vertical edge molding member having a top surface tapering down to an edge;

a horizontal edge molding member having a planar top surface tapering down to an edge; and a corner molding member having a planar horizontal top surface portion shaped to mate flush with a planar top surface of said horizontal edge molding member and a vertical top surface portion shaped to mate flush with a planar top surface portion of said vertical edge molding member.

23. The lamp fixture apparatus of claim 1 further including a first carpet insert slot located adjacent said first channel and a second carpet insert slot located beneath said second channel.

24. The lamp fixture apparatus of claim 6 further including a second carpet insert slot located beneath said second extruded channel.

25. A lighting apparatus comprising:

a stairstep mountable fixture having first and second openings in respective outer surfaces thereof, each opening oriented to facilitate direction of illumination from within said fixture in respective first and second directions; and a molding member mountable at an edge of said fixture and having a first outer surface shaped to mate flush with a top surface portion of said fixture and a second outer surface portion shaped to mate flush with a riser surface portion of said fixture, said molding member further being shaped to conceal electrical leads extending out of said fixture and to provide a finished appearance at said edge.

26. The lighting apparatus of claim 23 wherein said fixture further comprises a single piece extrusion having a vertical riser plate portion and horizontal tread plate portion.

27. The lighting apparatus of claim 26 wherein said extrusion is of a length selected to match the length of a nose portion of said stairstep.

28. The lighting apparatus of claim 27 wherein said each of said first and second openings runs the length of said extrusion.

29. The lighting apparatus of claim 25 further including a wireway means for conducting at least one electrical lead across a tread portion of said stairstep and further including means for covering said wireway means so as to provide a finished appearance.

30. The lighting apparatus of claim 25 further including a horizontal edge molding member and an electrical lead wireway formed therein.

31. The lighting apparatus of claim 25 wherein said fixture includes a riser plate portion and a tread plate portion and further including:

a vertical edge molding member;

a horizontal edge molding member; and wherein the first outer surface portion of said corner molding member mates flush with an outer surface portion of said horizontal edge molding member and wherein the second outer surface portion of said edge molding member mates flush with an outer surface portion of said vertical edge molding member.

32. The lighting apparatus of claim 25 further including a lens component mounted in at least one of said first and second openings.

33. A lighting apparatus comprising:

a stairstep mountable fixture having at least a first opening therein oriented to direct light in a selected direction; and molding means mountable at a side of said fixture for concealing electrical leads extending out of said fixture and for providing a finished appearance at said side.

34. The lighting apparatus of claim 33 wherein said fixture further comprises a single piece extrusion having a vertical riser plate portion and a horizontal tread plate portion.

35. The lighting apparatus of claim 34 wherein said extrusion is of a length selected to match the length of a nose portion of said stairstep.

36. The lighting apparatus of claim 35 wherein said opening runs the length of said extrusion.

37. The lighting apparatus of claim 33 wherein said molding means includes a corner molding member having at least one surface meeting flush with a cooperating surface of said fixture.

38. The lighting apparatus of claim 37 wherein said molding means further includes wireway means for conducting at least one electrical lead across a tread portion of said stairstep and further including means for covering said wireway means so as to provide a finished appearance.

39. The lighting apparatus of claim 37 wherein said molding means further includes a horizontal edge molding member and an electrical lead wireway formed therein.

40. The lighting apparatus of claim 33 wherein said fixture includes a riser plate portion and a tread plate portion and wherein said molding member means comprises:

a vertical edge molding member having a top surface tapering down to an edge;

a horizontal edge molding member having a top surface tapering down to an edge; and a corner molding member having a planar horizontal top surface portion shaped to mate flush with a planar top surface of said horizontal edge molding member and a vertical top surface portion shaped to mate flush with a planar top surface portion of said vertical edge molding member.

41. The lighting apparatus of claim 33 further including a lens component mounted in said at least a first opening.

42. A lighting apparatus comprising:

a stairstep mountable fixture having at least a first opening therein oriented to direct light in a selected direction; and a molding member mountable at an edge of said fixture and having a first outer surface shaped to mate flush with a top surface portion of said fixture and a second outer surface portion shaped to mate flush with a riser surface portion of said fixture, said molding member further being shaped to conceal electrical leads extending out of said fixture and to provide a finished appearance at said edge.

43. The lighting apparatus of claim 42 wherein said fixture further comprises a single piece extrusion having a vertical riser plate portion and horizontal tread plate portion.

44. The lighting apparatus of claim 43 wherein said extrusion is of a length selected to match the length of a nose portion of a step of said staircase.

45. The lighting apparatus of claim 44 wherein said opening runs the length of said extrusion.

46. The lighting apparatus of claim 42 further including a wireway means for conducting at least one electrical lead across a tread portion of said stairstep and further including means for covering said wireway means so as to provide a finished appearance.

47. The lighting apparatus of claim 42 further includes a horizontal edge molding member and an electrical lead wireway formed therein.

48. The lighting apparatus of claim 42 wherein said fixture includes a riser plate portion and a tread plate portion and further including:

a vertical edge molding member;

a horizontal edge molding member; and wherein the first outer surface portion of said corner molding member, mates flush with an outer surface portion of said horizontal edge molding member and wherein the second outer surface portion of said edge molding member mates flush with an outer surface portion of said vertical edge molding member.

49. The lighting apparatus of claim 42 further including a lens component mounted in said at least a first opening.

50. Lamp fixture apparatus for installation on a step having a riser portion and tread portion and comprising:

a single-piece extrusion having a riser plate portion and a horizontal tread plate portion;

a first channel formed in said horizontal tread plate portion and providing a channel opening disposed to open outwardly away from said tread portion of said step; and a second channel formed in said riser plate portion and providing a channel opening disposed to facilitate direction of light from a plurality of lamps toward a second step; and wherein the riser plate portion of said extrusion is translucent, wherein a plurality of lamps are located in said second channel, and further including a nonlight transmissive means for covering said second channel, whereby light is directed through the translucent structure of said riser plate and illuminates at least one surface thereof adjacent said second lens cover.

51. The lamp fixture apparatus of claim 50 wherein said horizontal tread plate portion comprises urethane and said riser plate portion comprises polyvinyl chloride, said horizontal tread plate and riser plate portions being coextruded together.

52. Lamp fixture apparatus for installation on a step having a riser portion and tread portion and comprising:

a single-piece extrusion having a riser plate portion and a horizontal tread plate portion;

a first channel formed in said horizontal tread plate portion and providing a channel opening disposed to open outwardly away from said tread portion of said step; and a second channel formed in said riser plate portion and providing a channel opening disposed to facilitate direction of light toward a second step; and wherein said horizontal tread plate portion comprises urethane and said riser plate portion comprises polyvinyl chloride, said horizontal tread plate and riser plate portions being coextruded together.

53. Lamp fixture apparatus for installation on a step having a riser portion and tread portion and comprising:

a single-piece extrusion having a riser plate portion and a horizontal tread plate portion;

at least one channel formed in said extrusion and providing an opening therein; and wherein a first portion of said extrusion is light transmissive and a second portion coextruded with said first portion is opaque, and wherein a plurality of lamps are located in said opening so as to illuminate said light transmissive portion.

54. The lighting apparatus for mounting on a first step comprising:

a step plate structure comprising a carpet insert slot of uniform cross-section, said step plate structure further including a first extruded channel of uniform cross-section positioned adjacent said carpet insert slot, said first channel having a floor and first and second vertical side walls, said first extruded channel further having an open top surface, said step plate structure further including a nose portion formed adjacent said first channel and positioned to overhang the step;

a second extruded channel located on an underside of said nose portion and having first and second side walls, the first and second side walls of said second extruded channel being disposed to facilitate directing light from a string of lights disposed in said second channel downward toward a tread surface of a second step; and a molding structure located at the edge of said step plate structure and having a surface shaped to conceal at least one of said channels while meeting flush with at least one surface of said step plate structure and permitting interior passage of electrical leads out of said at least one of said channels.

55. Apparatus for installation at the edge of a step where a riser portion of the step meets a horizontal tread portion of the step, said apparatus comprising:

a lamp fixture extrusion having a horizontal tread plate portion and a vertical riser portion integrally formed therewith;

a first channel formed in said horizontal tread plate portion, said first channel being disposed for directing illumination provided by a plurality of lamps located in said channel away from the horizontal tread portion of said step;

a second channel formed in said riser plate portion, said second channel being sized to accommodate a plurality of lamps and disposed for directing illumination provided by said lamps at an angle with respect to said riser plate portion, said angle lying within a range extending from parallel to said riser plate portion to at least 90 degrees away from said riser plate portion; and a molding structure located at an edge of said lamp fixture extrusion and having a surface shaped to conceal at least one of said channels while meeting flush with at least one surface of said lamp fixture extrusion and permitting interior passage of electrical leads out of at least one of said first and second channels.

56. Apparatus mountable in conjunction with a staircase and adaptable to provide illumination of a step of said staircase, said apparatus comprising:

an extruded step-mountable fixture having at least a first opening therein oriented to direct light in a selected direction; and a molding structure located at an edge of said fixture and having a surface shaped to conceal the edge of said fixture while meeting flush with a top surface of said fixture and permitting interior passage of electrical leads out of said edge.

57. The lighting apparatus of claim 15 further including a lens component mounted in at least one of said first and second openings.

* * * * *